US005761998A

United States Patent [19]

Fricke et al.

[11] Patent Number: 5,761,998

[45] Date of Patent: Jun. 9, 1998

[54] DEVICE FOR ALIGNING ON A FEEDING TABLE OF A SHEET-FED PRINTING PRESS

[75] Inventors: Andreas Fricke, Eberbach; Heiner Luxem, Wilhelmsfeld, both of Germany

[73] Assignee: Heidelberger Druckmaschinen AG, Heidelberg, Germany

[21] Appl. No.: 782,148

[22] Filed: Jan. 13, 1997

[30] Foreign Application Priority Data

Jan. 11, 1996 [DE] Germany ..... 196 00 793.3

[51] Int. Cl.[6] ..... B65H 9/06

[52] U.S. Cl. ..... 101/232; 271/245; 271/246

[58] Field of Search ..... 271/245, 246; 400/578, 596; 101/233, 234, 235, 232

[56] References Cited

U.S. PATENT DOCUMENTS

| | | | |
|---|---|---|---|
| 2,317,993 | 5/1943 | Harrold | 271/231 |
| 2,605,103 | 7/1952 | Backhouse | 271/245 |
| 2,613,930 | 10/1952 | Backhouse | 271/245 |
| 2,642,284 | 6/1953 | Backhouse | 271/261 |
| 3,006,637 | 10/1961 | Backhouse | 271/245 |
| 5,297,789 | 3/1994 | Filsinger et al. | 271/245 |
| 5,390,908 | 2/1995 | Luxem | 271/247 |
| 5,496,023 | 3/1996 | Becker et al. | 271/245 |
| 5,651,544 | 7/1997 | Stadler | 271/245 |

FOREIGN PATENT DOCUMENTS

| | | |
|---|---|---|
| 32 15 804 | 11/1982 | Germany . |
| 2 098 183 | 11/1982 | United Kingdom . |

*Primary Examiner*—Edgar S. Burr
*Assistant Examiner*—Daniel J. Colilla
*Attorney, Agent, or Firm*—Herbert L. Lerner; Laurence A. Greenberg

[57] ABSTRACT

A device for aligning sheets on a feeding table of a sheetfed printing press having at least one swivelably mounted top lay and at least one swivelably mounted front lay, and a control device for cyclically moving the at least one front lay and the at least one top lay includes a control device for the at least one top lay operative independently of the control device for cyclically moving the at least one front lay and the at least one top lay, the at least one top lay being disposed so as to be vertically movable and being constructed wider than the at least one front lay, and the at least one front lay being laterally encompassed by the at least one top lay.

6 Claims, 2 Drawing Sheets

DEVICE FOR ALIGNING ON A FEEDING TABLE OF A SHEET-FED PRINTING PRESS

BACKGROUND OF THE INVENTION

FIELD OF THE INVENTION

The invention relates to a device for aligning sheets on a feeding table of a sheet-fed printing press and, more particularly, to such a feeding table having at least one swivelably mounted top or cover lay and at least one swivelably mounted front lay.

The published German Patent Document DE 32 15 804 A1 discloses a swivelable front lay having a holder which is fastened to a cyclically swingingly driven front-lay shaft. A top or cover lay is swivelably mounted on the front-lay holder so that the top lay is swivelable with respect to the front lay.

Disadvantageous with regard to the publication DE 32 15 804 A1 is that the top lay is provided at the front-lay holder and is thereby affected by the swiveling movement of the front-lay holder. An adjustment of the front lay thus has an influence upon the setting of the top lay.

SUMMARY OF THE INVENTION

It is accordingly an object of the invention to provide a device for aligning sheets on a feeding table of a sheet-fed printing press, wherein front-lay motion and top-lay motion are controllable independently of one another.

With the foregoing and other objects in view, there is provided, in accordance with the invention, a device for aligning sheets on a feeding table of a sheetfed printing press having at least one swivelably mounted top lay and at least one swivelably mounted front lay, and a control device for cyclically moving the at least one front lay and the at least one top lay, comprising a control device for the at least one top lay operative independently of the control device for cyclically moving the at least one front lay and the at least one top lay, the at least one top lay being disposed so as to be vertically movable and being constructed wider than the at least one front lay, and the at least one front lay being laterally encompassed by the at least one top lay.

In accordance with another feature of the invention, the sheet-aligning device includes a roller lever having a swivel shaft, an eccentric adjusting device for the at least one top lay engaging with the swivel shaft of the roller lever, the swivel shaft representing a connection between the eccentric adjusting device and the roller lever, and a shaft for the at least one top lay swivelably mounted at an end of the roller lever.

In accordance with a further feature of the invention, the sheet-aligning device includes a swivelably mounted lever forming part of a four-bar linkage connected to the shaft of the at least one top lay for swiveling the at least one top lay.

In accordance with an added feature of the invention, the independently operative control device includes rotatable cams and cam followers, and the four-bar linkage is formed of respective levers and couplers, and the sheet-aligning device includes energy-storing devices fixed to a frame of the printing press and formed as compression springs engaging with the levers and the couplers of the four-bar linkage so that the cam followers continuously remain in operative contact with is the rotatable cams.

In accordance with an additional feature of the invention, the sheet-aligning device includes a plurality of the front lays and front-lay stops, respectively, formed in a row adjacent one another, and a respective top lay assigned to each of the front lays.

In accordance with a concomitant feature of the invention, the sheet-aligning device includes a shaft for the at least one front lay disposed below and proximate to the feeding table.

Advantageously, due to the separate independent control of the top lay or lays and the front lay or lays, the top lay may perform a lifting movement while the sheet to be conveyed continues to remain in engagement with the front lays, for example, while it is being laterally aligned. This measure allows more time to be available for the important alignment of the sheet edges, and the top-lay motion may be performed in a more desirable manner dynamically.

Mounting the top-lay shaft in a linkage (four-bar linkage) permits a complicated course of motions of the top lay. Lifting and lowering the top lay almost vertically in a setting of the top lay holder at the feeding table permits a particularly sheet-protecting lowering and lifting of the top lay so that the leading edge of the sheet may be prevented from becoming damaged, and the alignment of the sheet is not adversely affected. Moreover, lifting and lowering the top lay vertically makes it possible to process great sheet thicknesses of more than 1.6 mm, without any problems. A height-adjustment of the top lay brought about by an eccentric adjustment may be advantageously effected without influencing the front-lay setting.

By advantageously locating the swiveling point, i.e., the front-lay shaft, of the front lay in the proximity of the plane formed by the feeding table, the front lay is already lowered below the sheet-conveying plane even for small swiveling angles (for example, smaller than 10°) so that a dynamically favorable front-lay motion permitting high operating speeds is made possible.

In a particularly advantageous space-saving construction, the front lay is disposed inside the dimensions of the top lay. Thus, the number of front lays and the respective assigned top lays which are preferably distributed over the sheet width may be increased. As a result thereof, the respective leading edge of a sheet to be conveyed which abuts against or engages the front lays is not deformed very much by the overall contact surface formed by the number of front lays. Advantageously, this permits higher sheet-conveying speeds on the feeding table and a smooth sheet feeding, respectively.

Other features which are considered as characteristic for the invention are set forth in the appended claims.

Although the invention is illustrated and described herein as embodied in a device for aligning sheets on a feeding table of a sheet-fed printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
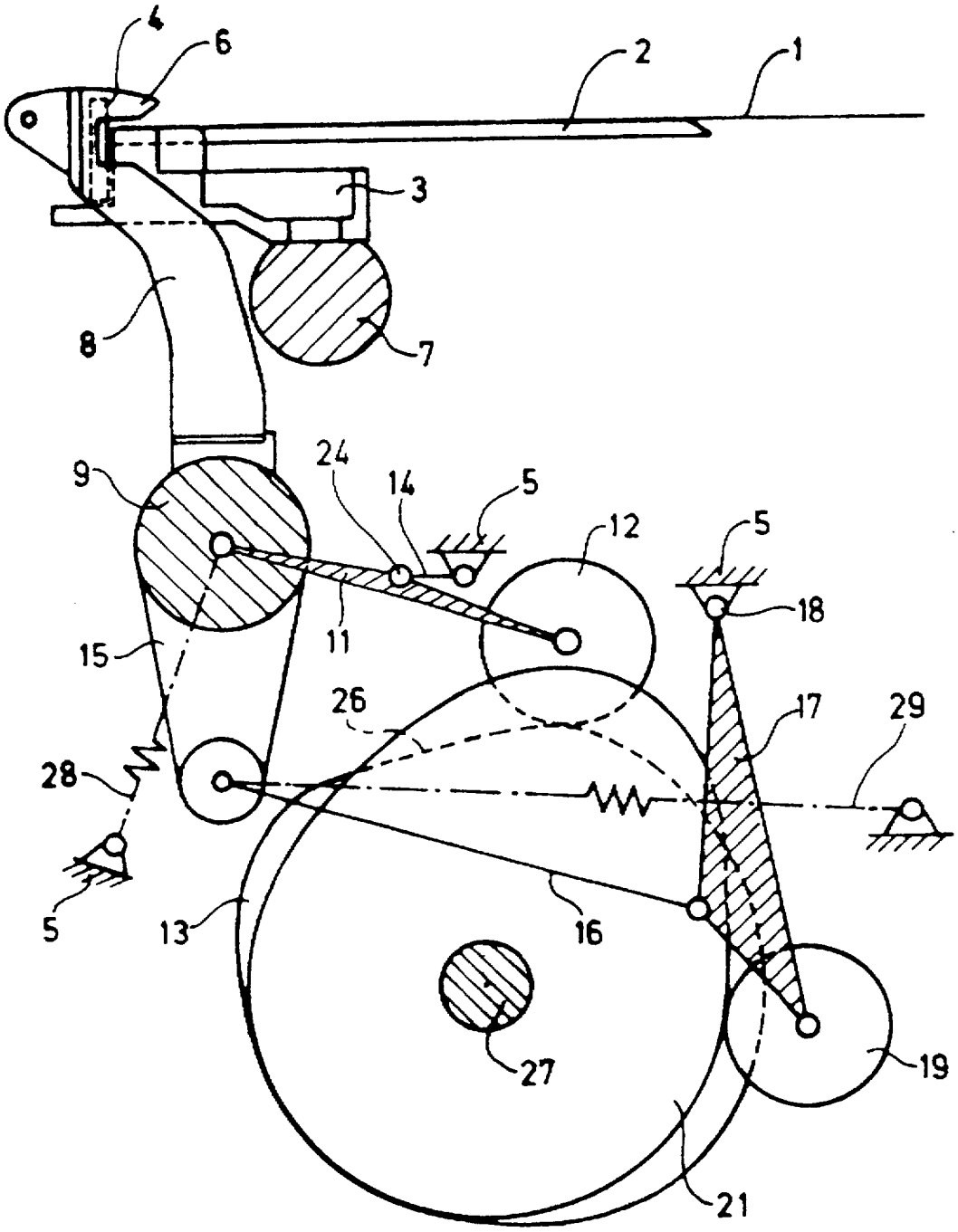
FIG. 1 is a diagrammatic and schematic sectional view of a top-lay/front-lay control system.

Referring now to the drawings and, first, particularly to FIG. 1 thereof, there are shown therein at least one front lay 3 having a stop 4 and one top or cover lay 6 provided for aligning a leading edge of a sheet 1 on a feeding table 2 of a sheet-fed printing press. The stop 4 is adjustable, respectively, in and opposite to a sheet-conveying direction, the stop 4 itself representing an adjusting device. The front lay 3 is fastened to a control device formed of a front-lay shaft 7 swivelably mounted in side frames 5 and operating in accordance with the operating cycle of the sheet-fed printing press. The front-lay shaft 7 is disposed below the feeding table 2 so closely thereto that, even when small pivoting angles of the front-lay shaft 7, for example, smaller than 10°, are involved, the front-lay stop 4 may be lowered below the plane formed by the feeding table 2. Preferably, a number of front-lay stops 4 are spaced apart from one another in a row. The top lay 6 is disposed at an end of a top-lay holder 8 fastened to a top-lay shaft 9. The top-lay shaft 9 is swivelably mounted in respective ends of a pair of symmetric roller levers 11, only one of which is shown in FIG. 1 of the drawings. At the opposite end of the roller lever 11, a respective cam follower 12 is carried which is in rolling contact with a respective cam disk 13.

The roller lever 11 is mounted by an eccentric adjusting device 14 so as to be swivelable with respect to the side frame 5.

A lever 15 having an end to which there is articulatedly connected a first end of a coupler 16 is fastened to the top-lay shaft 9. A second end of the coupler or connecting bar 16 is articulatedly connected to a roller lever 17. The roller lever 17 has a frame-fixed bearing 18 located at the side frame 5, and carries, at a free end thereof, a rotatably mounted cam follower 19 which is in rolling contact with a cam disk 21. The cam follower 19, the cam disk 21, the cam follower 12, the cam disk 13 and the shaft 9 form a drive mechanism of a control device for controlling the movement of the top lay 6. The roller lever 11, the lever 15, the coupler 16 and the roller lever 17 form a four-bar linkage for moving the top lay 6 in conjunction with the drive mechanism of the control device. The four-bar linkage forming the linking mechanism of the control device for moving the top lay 6.

Figure 2:
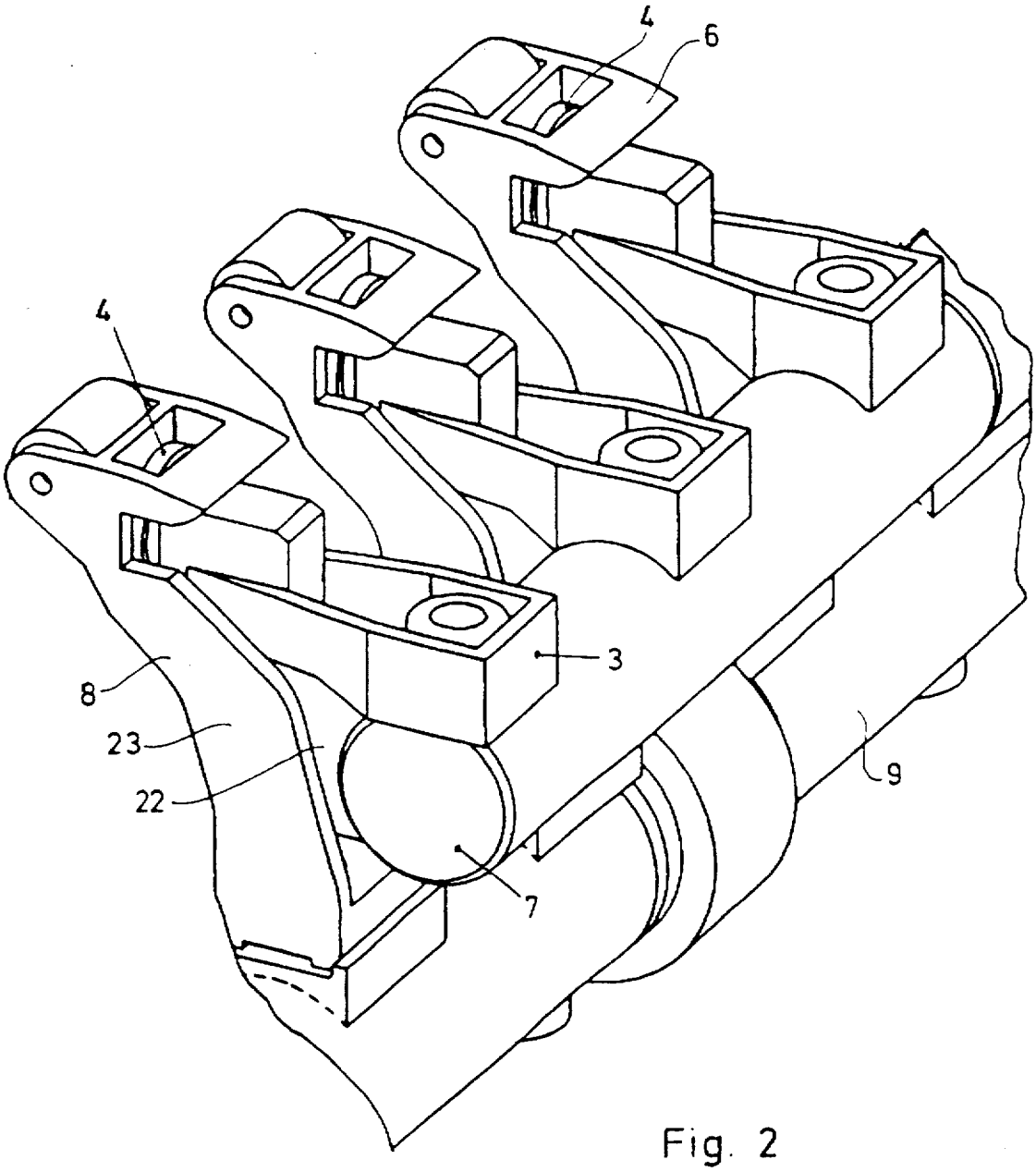
FIG. 2 is a perspective lefthand-side, front and top view of the top and front lays of FIG. 1.

As shown in FIG. 2, the top lay 6 and the top-lay holder 8 are constructed so as to be wider than the front-lay stop 4. The top-lay holder 8 has two side walls 22 and 23 between which there is disposed a respective front-lay stop 4 in such a manner that it is encompassed by the top lay 6.

In a position wherein the top lay 6 and the front lay 3 are disposed at the feed table 2, as shown in FIG. 1, the sheet 1 aligned at the front lays 3 in the sheet-conveying direction is taken by over by a non-illustrated accelerating device, for example, a pre-gripper, and transferred or surrendered to the printing press for further processing.

When processing cardboard or pasteboard, i.e., stock having paper thicknesses greater than 1.6 mm, for example, the leading edge of the sheet 1 is lifted, before the swiveling motion is introduced, in order to prevent the leading edge of the sheet, which has been aligned at the front lays 3, from being damaged when the top lay 6 is swiveled. The lifting is introduced by swiveling the roller levers 11 about a swivel axis 24 of the eccentric adjusting device 14, the cam follower 12 being in operative contact with a control valley 26 of the control cam 13, respectively, in the vicinity of the valley. The cam 21 and the two cam disks 13 are mounted on a common or joint drive shaft 27 so as to be fixed against rotation relative thereto.

After the top lay 6 has been lifted, the top lay 6 and the front lay 3 are simultaneously swiveled together with their respective top-lay shaft 9 and front-lay shaft 7 until they have both reached the reversal point thereof below a sheet-conveying plane. When they have swiveled back from the reversal point, the top lay 6 and the front lay 4 simultaneously reach a stop position thereof at the feeding table 2. The following sheet 1 to be transported abuts against the front lay 4 and is smoothened by the successive lowering of the top lay 6. A restoring spring 28 is constructed as a compression spring and engages, at one end thereof, with the top-lay shaft 9 and, at the other end thereof, with the side frame 5. A restoring spring 29 also constructed as a compression spring engages, at one end thereof, with the connecting link between the lever 15 and the coupler or connecting bar 16 and, at the other end thereof, with the side frame 5. This construction ensures a contact between the cam follower 12 and the cam disk 13, on the one hand, and between the cam follower 19 and the control cam 21, on the other hand, respectively. It is noted that the restoring springs 28 and 29 are energy storing devices.

We claim:

1. A device for aligning sheets on a feeding table of a sheet-fed printing press, comprising:

at least one swivelably mounted top lay;

at least one swivelably mounted front lay having a first and a second end;

a first control device for cyclically moving said at least one top lay;

a second control device for cyclically moving said at least one front lay, said first control device and said second control device operating independently from each other; and said at least one top lay being disposed so as to be vertically movable and being constructed wider than said at least one front lay, and said first end of said at least one front lay being laterally encompassed by said at least one top lay.

2. The device according to claim 1, including a roller lever having a swivel shaft, an eccentric adjusting device for said at least one top lay engaging with said swivel shaft of said roller lever, said swivel shaft providing a connection between said eccentric adjusting device and said roller lever, and a shaft for said at least one top lay swivelably mounted at an end of said roller lever.

3. The device according to claim 2, including a swivelably mounted first lever connected to said shaft of said at least one top lay for swiveling said at least one top lay.

4. The device according to claim 3, wherein said first control device includes first and second rotatable cams and first and second cam followers, and including a four-bar linkage formed of said first lever, a second lever, a third lever, and a coupler, said four-bar linkage is connected to said first and second cam followers and said shaft, and including compression springs fixed to a frame of the printing press and engaging with said levers and said coupler of said four-bar linkage so that said first and second cam followers continuously remain in operative contact with said first and second rotatable cams.

5. The device according to claim 1, including a plurality of said at least one front lay and each having a front-lay stop, respectively, formed in a row adjacent one another, and a respective top lay assigned to each of said at least one front lay.

6. The device according to claim 1, wherein said second control device has a shaft for swivelably moving said at least one front lay and said shaft is disposed below and proximate to the feeding table.

* * * * *